US010787003B2

(12) United States Patent
Moriya et al.

(10) Patent No.: US 10,787,003 B2
(45) Date of Patent: Sep. 29, 2020

(54) TREATMENT-LIQUID APPLICATION DEVICE, DRYING DEVICE, AND LIQUID DISCHARGE APPARATUS

(71) Applicants: Ryuuya Moriya, Kanagawa (JP); Masafumi Yamada, Kanagawa (JP)

(72) Inventors: Ryuuya Moriya, Kanagawa (JP); Masafumi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/294,353

(22) Filed: Mar. 6, 2019

(65) Prior Publication Data

US 2019/0275812 A1 Sep. 12, 2019

(30) Foreign Application Priority Data

Mar. 7, 2018 (JP) ..... 2018-041191
Feb. 6, 2019 (JP) ..... 2019-019535

(51) Int. Cl.
*B41J 11/00* (2006.01)
*F26B 3/347* (2006.01)

(52) U.S. Cl.
CPC ..... *B41J 11/002* (2013.01); *B41J 11/0015* (2013.01); *F26B 3/347* (2013.01)

(58) Field of Classification Search
CPC ... B41J 11/002; B41J 11/0015; B41J 11/0005; F25B 3/347; F25B 13/10
See application file for complete search history.

(56) References Cited

U.S. PATENT DOCUMENTS

| | | | | |
|---|---|---|---|---|
| 9,327,524 | B1 | 5/2016 | Yamada et al. | |
| 2007/0064026 | A1* | 3/2007 | Hirakawa | B41J 2/2114 347/6 |
| 2008/0001983 | A1* | 1/2008 | Kawakami | B41J 2/2114 347/14 |
| 2011/0310140 | A1* | 12/2011 | Tonohiro | B41J 11/0015 347/6 |
| 2014/0366760 | A1* | 12/2014 | Boland | B41J 11/002 101/424.1 |

FOREIGN PATENT DOCUMENTS

| | | |
|---|---|---|
| JP | 2014-217989 | 11/2014 |
| JP | 2016-065137 | 4/2016 |
| JP | 2016-112855 | 6/2016 |
| JP | 2017-119395 | 7/2017 |

* cited by examiner

*Primary Examiner* — Sharon A. Polk
(74) *Attorney, Agent, or Firm* — Duft & Bornsen, PC

(57) ABSTRACT

A treatment-liquid application device includes a treatment liquid applicator to apply a treatment liquid to an application target object to which a black liquid and a color liquid other than the black liquid are applied. The treatment liquid applicator applies a greater amount of the treatment liquid per unit area to at least a region to which the color liquid is applied than a region to which the black liquid is applied.

14 Claims, 6 Drawing Sheets

TREATMENT-LIQUID APPLICATION DEVICE, DRYING DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2018-041191, filed on Mar. 7, 2018, and 2019-019535, filed on Feb. 6, 2019, in the Japan Patent Office, the entire disclosure of each of which is incorporated by reference herein.

BACKGROUND

Technical Field

Aspects of the present disclosure relate to a treatment-liquid application device, a drying device, and a liquid discharge apparatus.

Related Art

As a printing apparatus for applying a liquid to an application target object such as a sheet material to perform printing, there is an apparatus including a drying device to promote drying of the applied liquid.

For example, an inkjet recording apparatus is known that includes a dielectric heater as a heater and an apparatus are known that applies a pretreatment liquid containing an infrared absorbing agent and then emitting infrared rays to perform heating, and the like.

SUMMARY

In an aspect of the present disclosure, there is provided a treatment-liquid application device that includes a treatment liquid applicator to apply a treatment liquid to an application target object to which a black liquid and a color liquid other than the black liquid are applied. The treatment liquid applicator applies a greater amount of the treatment liquid per unit area to at least a region to which the color liquid is applied than a region to which the black liquid is applied.

In another aspect of the present disclosure, there is provided a treatment-liquid application device that includes a treatment liquid applicator to apply a treatment liquid to an application target object to which a first liquid and a second liquid are applied, the first liquid including carbon black, the second liquid including no carbon black or a smaller amount of carbon black than the first liquid. The treatment liquid applicator applies a greater amount of the treatment liquid per unit area to at least a region to which the second liquid is applied than a region to which the first liquid is applied.

In still another aspect of the present disclosure, there is provided a treatment-liquid application device that includes a treatment liquid applicator to apply a treatment liquid to an application target object to which a black liquid and a color liquid other than the black liquid are applied. The treatment liquid applicator applies a smaller amount of the treatment liquid per unit area to at least a region to which the color liquid is applied than a region to which the black liquid is applied. A drying efficiency of the treatment liquid is lower than a drying efficiency of the black liquid.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
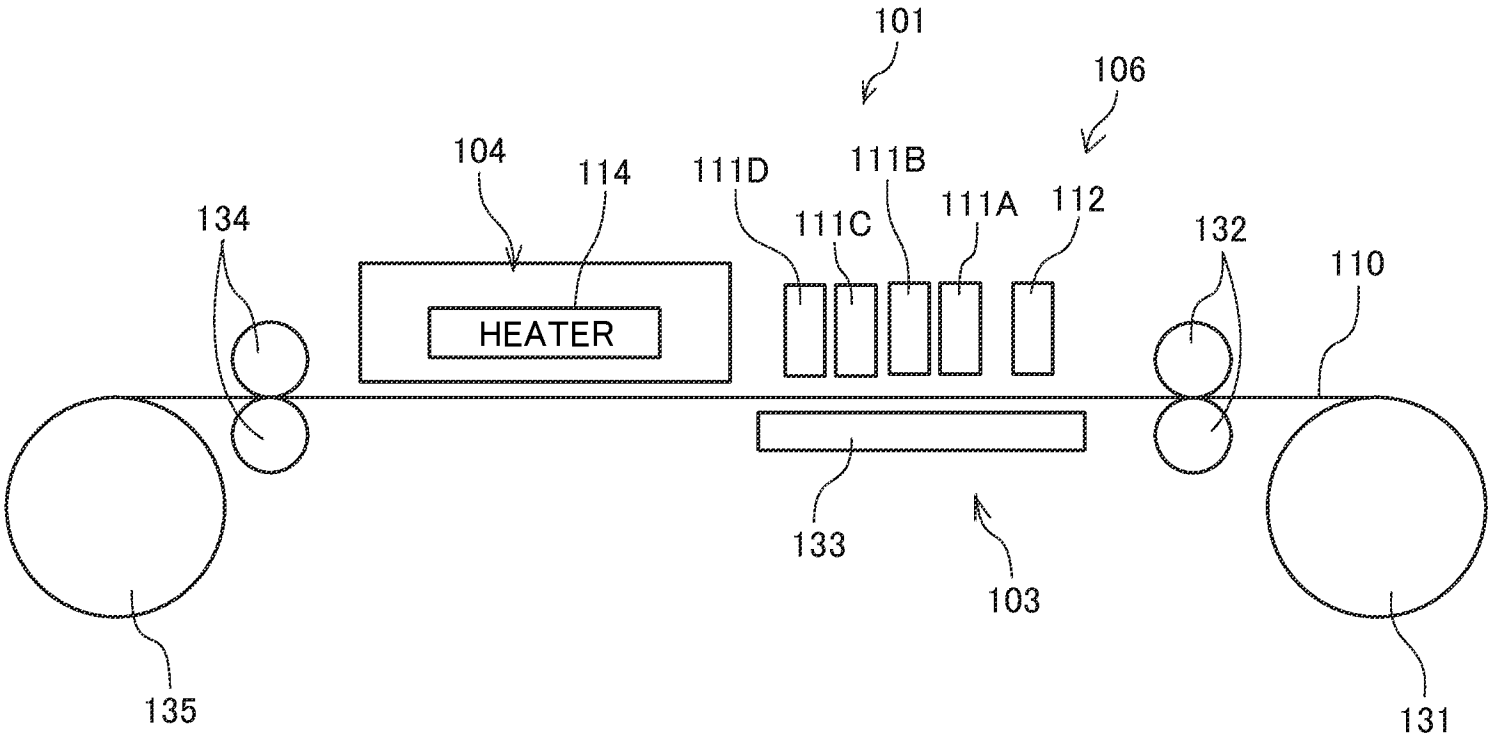
FIG. 1 is a schematic explanatory view of a printing apparatus as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
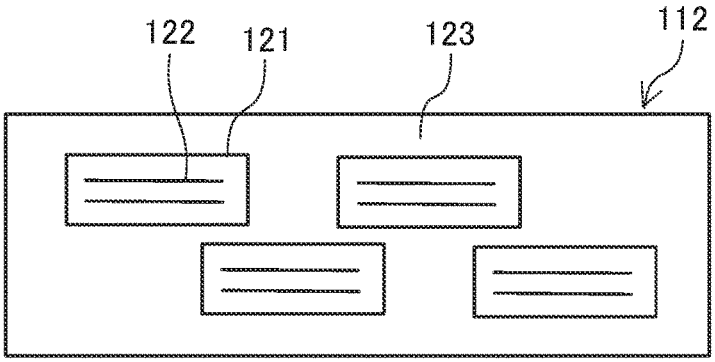
FIG. 2 is an explanatory plan view of an example of a treatment-liquid head of a treatment-liquid application unit in the printing apparatus.

Hereinafter, embodiments of the present disclosure will be described with reference to the attached drawings. First, a first embodiment of the present disclosure will be described with reference to FIGS. 1 and 2. FIG. 1 is a schematic explanatory view of a printing apparatus as a liquid discharge apparatus according to the first embodiment. FIG. 2 is an explanatory plan view of an example of a treatment-liquid head of a treatment-liquid application unit in the printing apparatus.

A printing apparatus 100 is an inkjet recording apparatus, and includes a printing device 101 for discharging an ink which is a liquid of a required color onto a continuous sheet 110 which is an application target object (a member to be conveyed, a heating target object, or a drying target object) to print an image.

In the printing device 101, liquid discharge heads 111 (111A to 111D) which are full line type liquid dischargers for four colors are arranged from an upstream side in a conveying direction (arrow direction) of the continuous sheet 110. The liquid discharge heads 111 discharge an ink of black K (black ink) which is a black liquid and inks of cyan C, magenta M, and yellow Y (color inks) which are color liquids onto the continuous sheet 110. Note that the type and number of colors are not limited thereto.

In the present embodiment, black ink is a first liquid containing carbon black and color ink is a second liquid not containing carbon black. In some embodiments, the second liquid may be a liquid containing a smaller amount of carbon black than the second liquid.

Here, each of the inks contains propylene glycol or glycerin.

On the upstream side of the printing device 101 in the continuous sheet conveying direction (moving direction), a treatment-liquid application unit 106 constituted by a treatment-liquid application device for applying a treatment liquid to the continuous sheet 110 according to the present embodiment is disposed. The treatment-liquid application unit 106 includes a treatment-liquid head 112 for discharging and applying a treatment liquid to the continuous sheet 110.

The treatment-liquid head 112 as an example of a treatment liquid applicator is constituted, for example, by a full line type head in which a plurality of liquid discharge heads 121 each having a nozzle row 122 for discharging a treatment liquid are arranged in a zigzag manner on a base member 123. By controlling the discharge amount from the heads 121, the application amount of the treatment liquid can be changed.

Incidentally, as a method for applying a treatment liquid, in addition to the above-described method using the treatment-liquid head 112, a transfer method using a roller or the like may be used. In the transfer method, a treatment liquid is selectively applied to a roller or the like temporarily, then the roller is brought into contact with a medium, and the treatment liquid can be thereby selectively applied to the medium.

The treatment-liquid application unit 106 applies a treatment liquid to a region other than a region to which a black ink is applied by the printing device 101 in an amount larger than that in the region to which the black ink is applied.

Here, the treatment liquid contains a solvent for increasing a dielectric constant. The dielectric constant of a liquid can be measured by a coaxial resonance method. Examples of a solvent for increasing a dielectric constant include water, propylene glycol, and glycerin (an inclusion is not limited).

On a downstream side of the printing device 101 in the conveying direction, a drier 104 including a heater 114 as a dielectric heating device for heating the continuous sheet 110 to which the treatment liquid and ink have been applied is disposed. The heater 114 heats the continuous sheet 110 by high-frequency dielectric heating.

A conveyor 103 for conveying the continuous sheet 110 to the treatment-liquid application unit 106, the printing device 101, and the drier 104 is included. The conveyor 103 includes a conveying roller 132 for conveying the continuous sheet 110 fed out from a feeding roll 131, a conveying guide member 133 for guiding the continuous sheet 110 conveyed in the opposite direction to the treatment-liquid application unit 106 and the printing device 101, an eject roller 134 for ejecting the continuous sheet 110 toward a winding roll 135 on a downstream side of the drier 104, and the like.

In the printing apparatus 100, while the conveyor 103 conveys the continuous sheet 110 fed out from the feeding roll 131, the treatment-liquid application unit 106 applies a treatment liquid to the continuous sheet 110, the printing device 101 prints a required image on the continuous sheet 110, the drier 104 dries the continuous sheet 110, and the continuous sheet 110 is wound by the winding roll 135.

Figure 3:
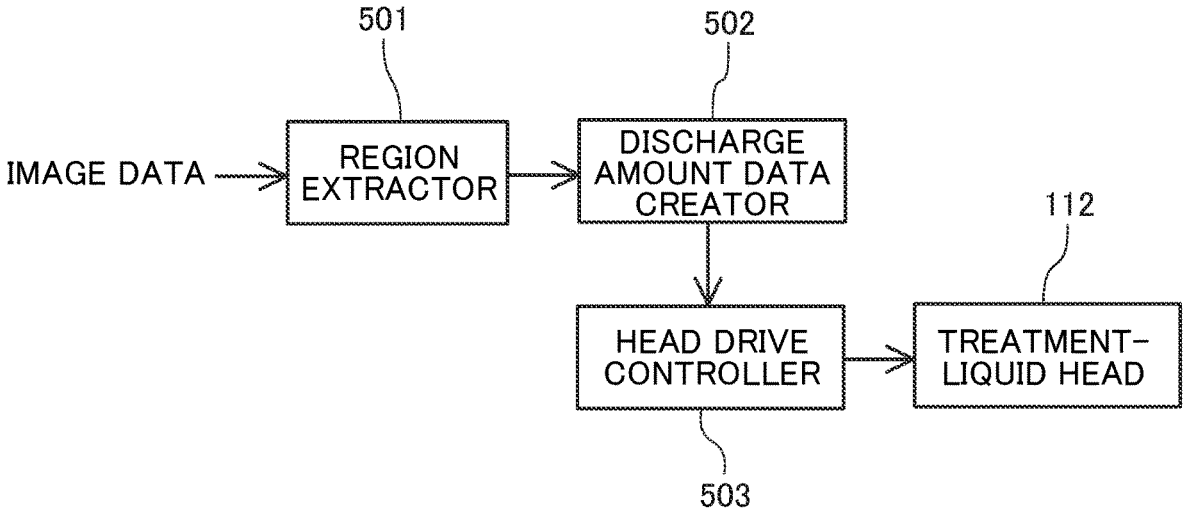
FIG. 3 is a block diagram of portions relating to control of application of a treatment liquid in the treatment-liquid application unit.

Next, a portion related to control of application of a treatment liquid in the treatment-liquid application unit 106 will be described with reference to the block diagram of FIG. 3.

A region extractor 501 extracts a region to which a black ink is not to be applied from image data, in other words, a region to which color inks are applied. A discharge amount data creator 502 creates discharge amount data in which the application amount to be applied per unit area to a region to which a black ink is not applied is larger than the application amount per unit area in a region to which a black ink is applied from the extraction result of the region extractor 501.

The head drive controller 503 drives the treatment-liquid head 112 in accordance with the discharge amount data created by the discharge amount data creator 502 to discharge the treatment liquid. At this time, the treatment-liquid application amount per unit area in a region to which a black ink is not applied, in other words, a region to which color inks are applied is larger than the treatment-liquid application amount per unit area in a region to which a black ink is applied.

Figure 4:
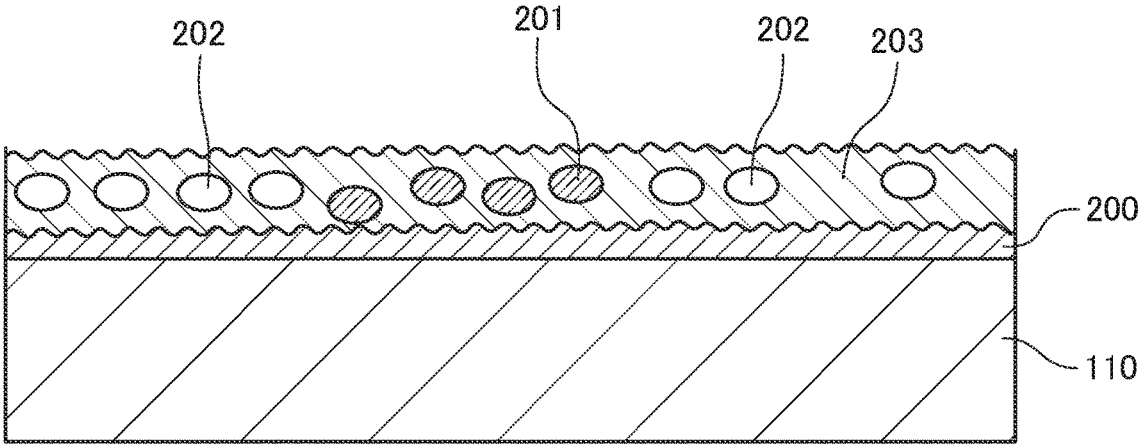
FIG. 4 is a schematic explanatory view for explaining an action in the first embodiment.

Next, an action in the present embodiment will be described with reference to FIG. 4. FIG. 4 is a schematic explanatory view used for the explanation.

In the present embodiment, as illustrated in FIG. 4, the treatment-liquid application unit 106 discharges and applies a treatment liquid 200 to a surface (printing surface) of the continuous sheet 110. The treatment liquid 200 contains a solvent for increasing a dielectric constant as described above.

At this time, application control is performed such that the application amount of the treatment liquid 200 per unit area in a region other than a region to which a black ink 201 is applied (here, a region to which a color ink 202 is applied) is larger than the application amount of the treatment liquid 200 per unit area in the region to which the black ink 201 is applied. In other words, the application amount of the treatment liquid 200 per unit area that is applied by a treatment liquid applicator is larger in a region to which color liquid (the color ink 202) is applied than a region to which the black ink 201 is applied.

Then, the black ink 201 and the color ink 202 are discharged from the liquid discharge head 111 of the printing device 101 onto a printing surface of the continuous sheet 110 to which the treatment liquid 200 has been applied, and an image is printed. The black ink 201 contains carbon black to serve as a conductive ink, and the color ink 202 containing no carbon black serves as a non-conductive ink. Incidentally, in FIG. 4, the solvent 203 contained in the inks 201 and 202 is illustrated separately from the inks 201 and 202.

Thereafter, the continuous sheet 110 that has passed through the printing device 101 passes through the drier 104 including the dielectric heater 114 to be heated by dielectric heating.

At this time, heating efficiency in the region to which the black ink 201 as a conductive ink has been applied is relatively higher than that in the region to which the color ink 202 has been applied. Therefore, if the application amount of the treatment liquid 200 is constant, in a case where dielectric heating is performed in accordance with the black ink 201, the region to which the color ink 202 as a non-conductive ink has been applied is heated insufficiently.

Therefore, even when the application amount of the treatment liquid 200 containing a solvent for increasing a dielectric constant to be applied to the region to which the color ink 202, in other words, a solvent having a higher dielectric constant than at least the dielectric constant of the color ink has been applied is increased, and dielectric heating is performed in accordance with the black ink 201, the region to which the color ink 202 has been applied is also heated sufficiently.

This makes it possible to reduce heating unevenness in the region to which the black ink 201 has been applied and the region to which the color ink 202 has been applied.

In other words, in the present embodiment, when the treatment liquid 200 is applied to an application target object to which the first liquid containing carbon black and the second liquid not containing carbon black are applied, the treatment liquid 200 is applied with a larger application amount per unit area to at least a region to which the second liquid is applied than to a region to which the first liquid is applied. That is, the application amount of the treatment liquid 200 per unit area that is applied by the treatment liquid applicator is larger in a region to which the second liquid is applied than in a region to which the first liquid is applied. Such a configuration can reduce heating unevenness in the region to which the black ink 201 has been applied and the region to which the color ink 202 has been applied.

Figure 5:
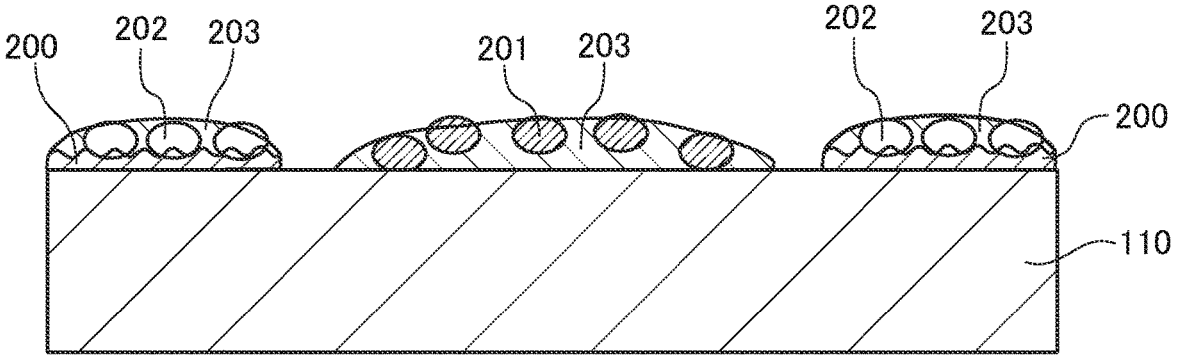
FIG. 5 is a schematic explanatory view for explaining an application state of a treatment liquid in a second embodiment of the present disclosure.

Next, a second embodiment of the present disclosure will be described with reference to FIG. 5. FIG. 5 is a schematic explanatory view for explaining an application state of a treatment liquid in the second embodiment.

In the present embodiment, a treatment liquid 200 is not applied to a region to which a black ink 201 is applied, but the treatment liquid 200 is applied to a region to which a color ink 202 is applied. Also in this configuration, the application amount of the treatment liquid 200 in a region to which the color ink 202 is applied, other than a region to which the black ink 201 is applied, is larger than the application amount (zero) of the treatment liquid 200 in the region to which the black ink 201 is applied.

Therefore, as in the first embodiment, it is possible to reduce heating unevenness in the region to which the black ink 201 has been applied and the region to which the color ink 202 has been applied.

Figure 6:
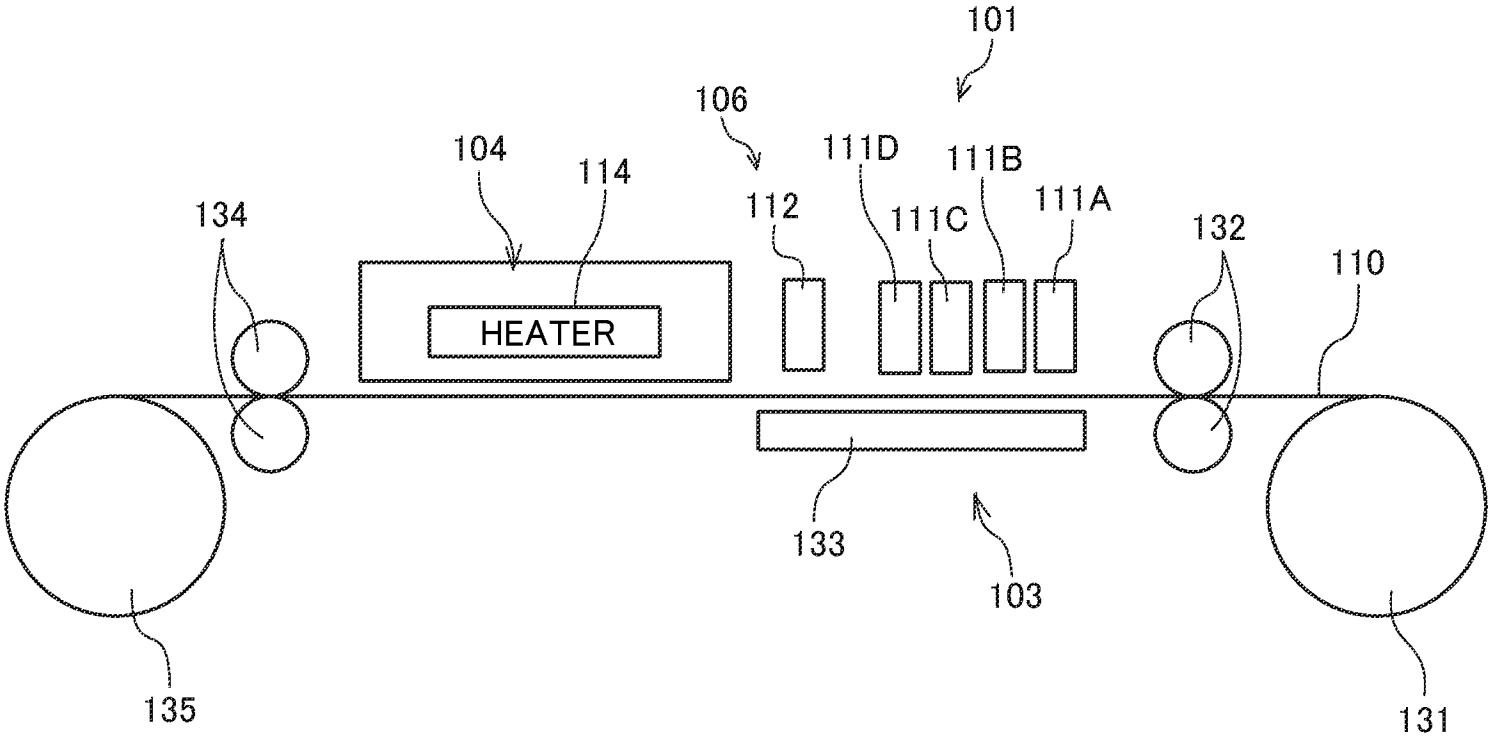
FIG. 6 is a schematic explanatory view of a printing apparatus as a liquid discharge apparatus according to a third embodiment of the present disclosure

Next, a third embodiment of the present disclosure will be described with reference to FIG. 6. FIG. 6 is a schematic explanatory view of a printing apparatus as a liquid discharge apparatus according to the third embodiment.

In the present embodiment, a treatment-liquid application unit 106 is disposed on a downstream side of a printing device 101 in a conveying direction.

Also with such a configuration, it is possible to obtain similar effects to those of the above-described embodiments.

Figure 7:
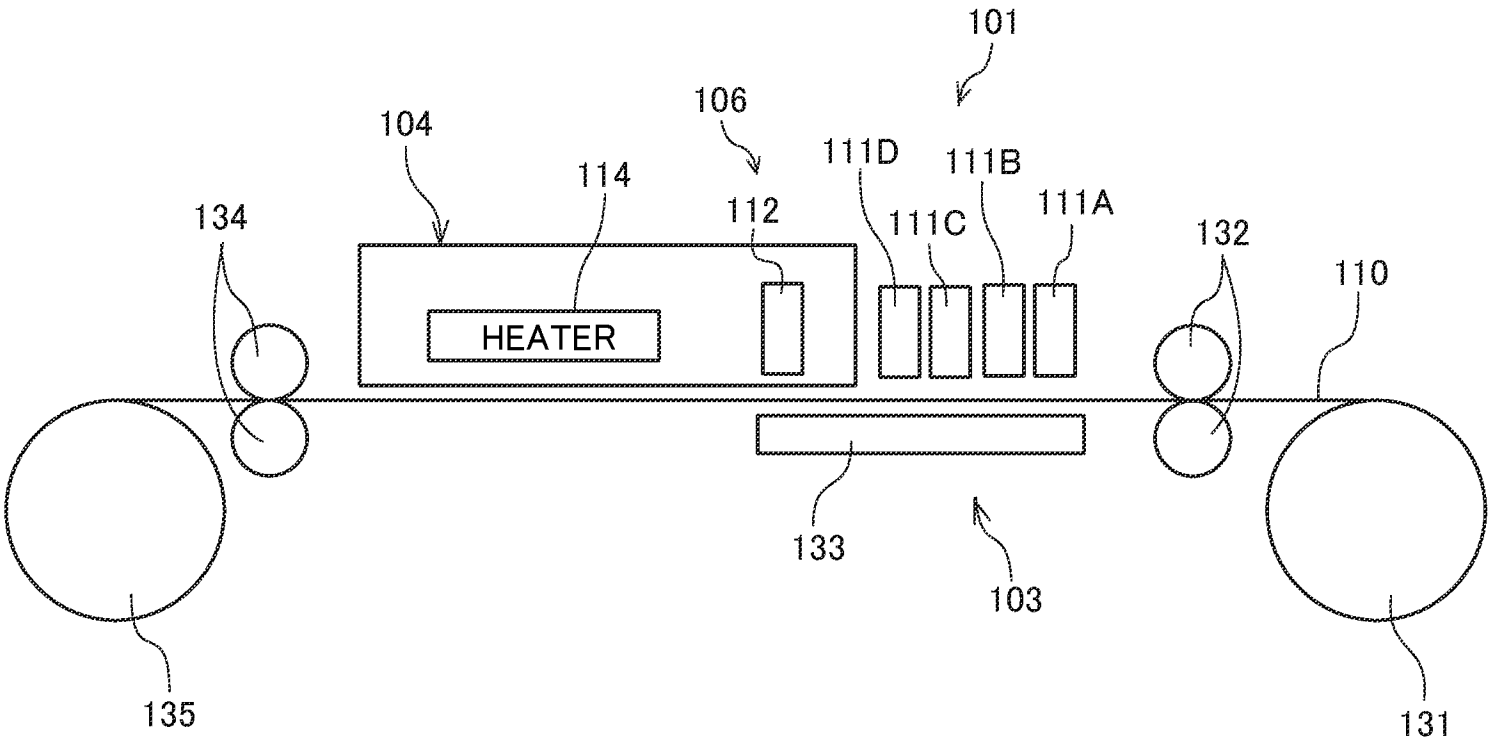
FIG. 7 is a schematic explanatory view of a printing apparatus as a liquid discharge apparatus according to a fourth embodiment of the present disclosure.

Next, a fourth embodiment of the present disclosure will be described with reference to FIG. 7. FIG. 7 is a schematic explanatory view of a printing apparatus as a liquid discharge apparatus according to the fourth embodiment.

In the present embodiment, a drier 104 as a drying device according to an embodiment of the present disclosure includes a treatment-liquid application unit 106 which is a treatment-liquid application device according to an embodiment of the present disclosure and a heater 114 which is a heating device.

Also with such a configuration, it is possible to obtain similar effects to those of the above-described embodiments.

Figure 8:
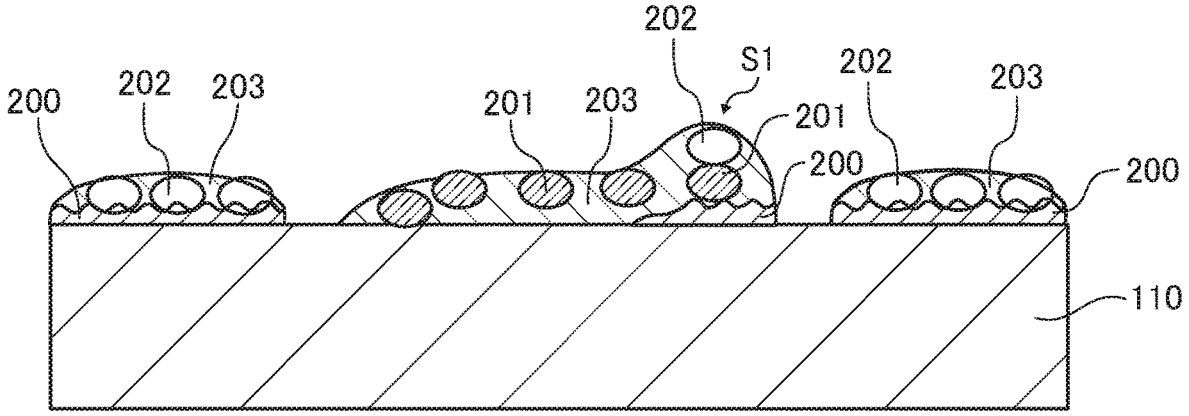
FIG. 8 is a schematic explanatory view for explaining an application state of a treatment liquid in a fifth embodiment of the present disclosure.

Next, a fifth embodiment of the present disclosure is described with reference to FIG. 8. FIG. 8 is a schematic explanatory view for explaining an application state of a treatment liquid in the fifth embodiment.

In the present embodiment, when there is an overlapping application area S1 in which the color ink 202 and the black ink 201 are applied in an overlapping manner, the overlapping application area S1 is determined as the region to which the color ink 202 is applied and the application amount of the treatment liquid 200 per unit area is set to be larger than in the region to which only the black ink 201 is applied.

In other words, the application amount of the treatment liquid 200 per unit area is set to be larger in the overlapping application area S1, to which the first liquid and the second liquid are applied in an overlapping manner, as the region to which the second liquid is applied than in the region to which the first liquid is applied.

That is, when no ignition or yellowing of the black ink 201 occurs until the drying of the color ink 202 ends, the treatment liquid 200 can be applied to even a region to which the black ink 201 is applied. In infrared irradiation, the difference from the drying efficiency of the black ink 201 is smaller than in high-frequency dielectric heating, the treatment liquid 200 can be applied to a region to which the black ink 201 is applied.

For example, assume that both the application amount of the treatment liquid 200 per unit area and the irradiation amount of energy to be applied per unit area are the same between the region (black region) to which the black ink 201 is applied and the region to which other color ink is applied. In such a case, for example, when the treatment liquid 200 is used in combination with an energy irradiator so that the ratio of drying time is 1:5 between black color and other colors, dot pattern data for applying the treatment liquid 200 is formed to control discharge of the solvent so that the content of the treatment liquid 200 is five times greater in other color region than in black region.

In the above-described embodiment, the treatment liquid contains a solvent that increases the dielectric constant. However, in some embodiments, the treatment liquid may contain a solvent that increases the conductivity. For example, water usually contains some kind of ions (although completely pure water has no conductivity) and as an example other than water, glycerin has conductivity although a low value. In high-frequency dielectric heating, conductivity strongly affects heat generation particularly at high frequencies (around 40 MHz), and not only conductivity but also dielectric constant affects heat generation in the band of microwave frequencies (2.45 GHz or more).

When the treatment liquid contains a solvent that increases the conductivity, the application amount of the treatment liquid is determined based on the ratio of the conductivity per unit area in the application region of black ink to the conductivity per unit area in the application region of cyan ink after application of the treatment liquid. For example, when the black ink conductivity is 0.06 S/m and the color ink conductivity (for example, cyan ink: 0.05 S/m), no treatment liquid is applied to the application region of black ink and the treatment liquid having a conductivity of 0.07 S/m is applied to the application region of cyan ink at the same amount as the application amount of the cyan ink.

The conductivity of the solvent used for the treatment liquid is preferably determined in accordance with the conductivity of a color ink having the lowest conductivity among the color inks. In such a case, the conductivity of the solvent can be appropriately adjusted by setting the amount of treatment liquid to be applied to the region of other color ink to be lower than the amount of treatment liquid applied to the region of the color ink having the lowest conductivity.

In addition, the treatment liquid can be determined in consideration of both conductivity and dielectric constant depending on the degree of influence on heat generation. For example, in the above-described band of microwave frequencies (2.45 GHz or higher), it is preferable to use a treatment liquid prepared in consideration of both electric conductivity and dielectric constant.

When the treatment liquid is not applied under the black ink, a solvent for increasing the drying efficiency of the color ink region (a solvent having at least one of a higher dielectric constant and a higher conductivity than a dielectric constant and a conductivity, respectively, of the color ink) is used. When the treatment liquid is applied under the black ink, a solvent for increasing the drying efficiency of the black ink region and the color ink region (a solvent having at least one of a higher dielectric constant and a higher conductivity than a dielectric constant and a conductivity, respectively, of each of the black ink and other color inks) is used.

Note that the above embodiments are described using an example in which the treatment liquid is a treatment liquid for increasing a dielectric constant, but the treatment liquid may be a treatment liquid for increasing infrared absorption efficiency. In other words, any treatment liquid may be used as long as drying efficiency is improved by energy application.

Even when the black ink and the color ink are very high in drying property, it is also conceivable that drying unevenness may occur due to too quick drying of the black ink. In such a case, a treatment liquid can be used that lowers at least one of dielectric constant and conductivity.

At this time, the treatment liquid is applied to the region to which the black ink is applied rather than the region where the color ink is applied.

When the treatment liquid is not applied under the black ink, a solvent for decreasing the drying efficiency of the color ink region (a solvent having at least one of a lower dielectric constant and a lower conductivity than a dielectric constant and a conductivity, respectively, of the color ink) is used. When the treatment liquid is applied under the black ink, a solvent for decreasing the drying efficiency of the black ink region and the color ink region (a solvent having at least one of a lower dielectric constant and a lower conductivity than a dielectric constant and a conductivity, respectively, of each of the black ink and other color inks) is used.

In addition, the above embodiments are described using an example in which the application target object is a continuous sheet, but the present disclosure is not limited thereto. The application target object is not particularly limited as long as being a member to which a treatment liquid is applied by a treatment-liquid application device according to an embodiment of the present disclosure. Examples of the application target object include a continuous body such as a continuous sheet, roll paper, or a web, a cut sheet material, wall paper, and an electronic circuit board sheet such as a prepreg.

In a case where a treatment-liquid application target object is subjected to printing, in addition to recording a character such as an ink and an image such as a graphic, an image having no meaning, such as a pattern, may be applied as a liquid such as an ink for the purpose of decoration or the like.

In the present application, a liquid to be applied is not particularly limited, but preferably has a viscosity of 30 mPa·s or less at ordinary temperature and ordinary pressure or by heating and cooling. More specific examples of the liquid include a solution, a suspension, and an emulsion containing a solvent such as water or an organic solvent, a colorant such as a dye or a pigment, a functionalizing material such as a polymerizable compound, a resin, or a surfactant, a biocompatible material such as deoxyribonucleic acid (DNA), an amino acid, a protein, or calcium, or an edible material such as a natural dye. These liquids can be used, for example, for an inkjet ink, a surface treatment liquid, a liquid for forming a constituent element of an electronic element or a light-emitting element or an electronic circuit resist pattern, or a three-dimensional modeling material liquid.

When a liquid discharge head is used as a treatment liquid applicator, examples of an energy generating source for discharging a liquid include those using a piezoelectric actuator (laminated piezoelectric element and thin film piezoelectric element), a thermal actuators using an electrothermal transducer such as a heat generating resistor, and an electrostatic actuator including a diaphragm and a counter electrode.

Incidentally, in printing in the present application, image formation, recording, letter printing, photograph printing, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A treatment-liquid application device comprising a treatment liquid applicator to apply a treatment liquid to an application target object to which a black liquid and a color liquid other than the black liquid are applied, wherein the treatment liquid applicator applies a greater amount of the treatment liquid per unit area to at least a region to which the color liquid is applied than a region to which the black liquid is applied.

2. The treatment-liquid application device according to claim 1, wherein the treatment liquid is a treatment liquid to increase conductivity.

3. The treatment-liquid application device according to claim 1, wherein the treatment liquid is a treatment liquid to increase dielectric constant.

4. The treatment-liquid application device according to claim 1, wherein the treatment liquid applicator does not apply the treatment liquid to the region to which the black liquid is applied.

5. The treatment-liquid application device according to claim 1, wherein the treatment liquid comprises propylene glycol or glycerin.

6. A drying device comprising:

the treatment-liquid application device according to claim 1; and a heating device to heat the application target object.

7. The drying device according to claim 6, wherein the heating device is a dielectric heating device.

8. A liquid discharge apparatus comprising:

the drying device according to claim 6; and a liquid discharger to apply the black liquid and the color liquid to the application target object.

9. A liquid discharge apparatus comprising:

the treatment-liquid application device according to claim 1; and a liquid discharger to apply the black liquid and the color liquid to the application target object.

10. The liquid discharge apparatus according to claim 9, wherein the treatment-liquid application device is disposed on an upstream side of the liquid discharger in a movement direction of the application target object.

11. The liquid discharge apparatus according to claim 9, wherein the treatment-liquid application device is disposed on a downstream side of the liquid discharger in a movement direction of the application target object.

12. The liquid discharge apparatus according to claim 9, wherein the liquid comprises propylene glycol or glycerin.

13. The treatment-liquid application device according to claim 1, wherein a drying efficiency of the treatment liquid is higher than a drying efficiency of the color liquid.

14. A treatment-liquid application device comprising:

a treatment liquid applicator to apply a treatment liquid to an application target object to which a first liquid and a second liquid are applied, the first liquid including carbon black, the second liquid including no carbon black or a smaller amount of carbon black than the first liquid, wherein the treatment liquid applicator applies a greater amount of the treatment liquid per unit area to at least a region to which the second liquid is applied than a region to which the first liquid is applied.

* * * * *